US011548716B2

(12) United States Patent
Cheng et al.

(10) Patent No.: US 11,548,716 B2
(45) Date of Patent: Jan. 10, 2023

(54) MICROWAVE HEATING SHEET

(71) Applicant: Food Industry Research and Development Institute, Hsinchu (TW)

(72) Inventors: Yu-Chi Cheng, Tainan (TW); Chun-Fong Lin, Hsinchu (TW); Yi-Jhen Wu, Hsinchu (TW); Binghuei-Barry Yang, Chiayi (TW)

(73) Assignee: Food Industry Research and Development Institute, Hsinchu (TW)

( * ) Notice: Subject to any disclaimer, the term of this patent is extended or adjusted under 35 U.S.C. 154(b) by 676 days.

(21) Appl. No.: 16/518,542

(22) Filed: Jul. 22, 2019

(65) Prior Publication Data

US 2020/0307894 A1 Oct. 1, 2020

(30) Foreign Application Priority Data

Apr. 1, 2019 (TW) ..... 108111480

(51) Int. Cl.

| | |
|---|---|
| ***H05B 6/80*** | (2006.01) |
| ***B65D 81/34*** | (2006.01) |
| ***H05B 6/64*** | (2006.01) |
| ***B65D 65/42*** | (2006.01) |

(52) U.S. Cl.

CPC ..... *B65D 81/3446* (2013.01); *B65D 65/42* (2013.01); *H05B 6/6494* (2013.01);

(Continued)

(58) Field of Classification Search

CPC .... B65D 81/2038; B65D 81/24; B65D 81/26; B65D 81/264; B65D 81/266; B65D 81/28; B65D 81/3272; B65D 81/34; B65D 81/3446; B65D 81/3453; B65D 81/3461; B65D 81/3469; B65D 2581/344; B65D 2581/3443; B65D 2581/3447; B65D 2581/3448; B65D 2581/3452; B65D 2581/3456; B65D 2581/3464; B65D 2581/3466; B65D 2581/3468; B65D 2581/3472; B65D 2581/3478; B65D 2581/3479; B65D 2581/3481;

(Continued)

(56) References Cited

U.S. PATENT DOCUMENTS

| | | |
|---|---|---|
| 4,641,005 A | 2/1987 | Seiferth |
| 4,914,266 A | 4/1990 | Parks et al. |

(Continued)

FOREIGN PATENT DOCUMENTS

| | | |
|---|---|---|
| CN | 1826222 A | 8/2006 |
| TW | 201213636 A | 4/2012 |

OTHER PUBLICATIONS

Riyanto et al., "Microwave Absorbent Packaging Material from Composites Chitosan-Polyvinyl Alcohol Polymer," Journal Pengolahan Hasil Perikanan Indonesia, Nov. 2014, 17(2):92-102 (English Abstract).

(Continued)

*Primary Examiner* — Hung D Nguyen
(74) *Attorney, Agent, or Firm* — Fish & Richardson P.C.

(57) ABSTRACT

A microwave heating sheet includes a substrate and a heating layer disposed on a first surface of the substrate. The heating layer includes a polar solvent that has a boiling point of not less than 100° C. and a polyelectrolyte that is dissolved in the polar solvent.

5 Claims, 3 Drawing Sheets

(52) U.S. Cl.
CPC ..... *B65D 2581/3468* (2013.01); *B65D 2581/3485* (2013.01)

(58) Field of Classification Search
CPC .... B65D 2581/3482; B65D 2581/3483; B65D 2581/3485; B65D 2581/3494; B65D 2581/3498; H05B 6/64; H05B 6/6408; H05B 6/6494
USPC ..... 219/725, 730, 759
See application file for complete search history.

(56) References Cited

U.S. PATENT DOCUMENTS 5,132,144 A 7/1992 Parks
5,389,767 A * 2/1995 Dobry ..... H05B 6/64 219/730
5,403,998 A * 4/1995 Sheen ..... B65D 65/46 219/730

OTHER PUBLICATIONS

Search Report in Chinese Appln. No. 201910455155.7, dated Jan. 11, 2022, 8 pages (with English translation).
Search Report in Taiwanese Appln. No. 108111480 dated Jul. 14, 2021, 2 pages (with English translation).
Search Report in Taiwanese Appln. No. 108111480, dated Dec. 3, 2019, 2 pages (with English translation).
Search Report in Taiwanese Appln. No. 108111480, dated Oct. 15, 2021, 2 pages (with English translation).

* cited by examiner

MICROWAVE HEATING SHEET

CROSS-REFERENCE TO RELATED APPLICATION

This application claims priority of Taiwanese Patent Application No. 108111480, filed on Apr. 1, 2019.

FIELD

The disclosure relates to a heating sheet, and more particularly to a microwave heating sheet.

BACKGROUND

Popularization of microwave ovens has driven various innovations in microwave heating of frozen food. Despite the frozen food being heated in a relatively convenient manner, mere microwave heating is still ineffective in removing water moisture that causes surface softness (i.e., non-crispy texture) of the heated food. Thus, a microwave heating package, known as a microwave susceptor, is usually utilized to solve this problem.

The microwave heating package assists in microwave heating of food by absorbing microwave energy and then converting the absorbed microwave energy to thermal energy, and thereafter transferring the thermal energy to the food by means of conduction and/or convection. The microwave heating package may be manufactured as a food wrapper with a microwave heating material being embedded or coated therein, so that the surface of the food wrapper may reach a temperature ranging from 120° C. to 200° C. during microwave heating, thereby making the heated food crispy in texture. This type of microwave heating package, which is divided into metalized and non-metalized ones, has been commercialized as a food packaging product, and thus can enable microwave ovens to cook foods once thought to require a conventional oven such as popcorn and pizza.

The metalized type microwave heating package refers to a microwave heating package with an entire or partial surface thereof embedded with a very thin metal material that generally has a thickness less than a nanometer range, which allows the metal material to absorb microwave energy and to produce induced electrical current so as to generate thermal energy. For example, U.S. Pat. No. 4,641,005 discloses a food receptacle for use in microwave cooking, in which a microwave energy-absorbing thin film of aluminum is incorporated onto a surface of a flexible substrate by vacuum vapor deposition, and then the substrate is integrally formed into a receptacle that conforms to the configuration of the to-be-heated food.

On the other hand, the non-metalized type microwave heating package refers to a microwave heating package that utilizes double bond resonance of graphite or ion polarization to generate thermal energy. For example, U.S. Pat. No. 4,914,266 discloses a food packaging having a pattern of microwave susceptor that utilizes a mixture of graphite, nitrocellulose and a solvent-based ink vehicle as a coating for absorbing microwave energy, and investigates the effect of different component ratios on temperature rise. Further, U.S. Pat. No. 5,132,144 discloses a microwave oven susceptor packaging that utilizes graphite dispersed in a sodium silicate solution as an aqueous-based coating for absorbing microwave energy.

Since the aforesaid microwave heating packages are unsatisfactory, there is still a need to improve the composition of the microwave heating package and even to develop a novel heating mechanism thereof, so that a more efficient cooking of food by microwave heating can be achieved.

SUMMARY

Therefore, an object of the present disclosure is to provide a microwave heating sheet that can alleviate at least one of the drawbacks of the prior art.

According to the present disclosure, a microwave heating sheet includes a substrate and a heating layer disposed on a first surface of the substrate. The heating layer includes a polar solvent that has a boiling point of not less than 100° C. and a polyelectrolyte that is dissolved in the polar solvent.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
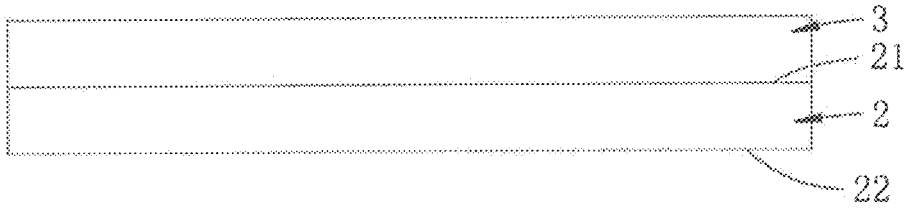
FIG. 1 is a schematic front view illustrating a first embodiment of a microwave heating sheet according to the present disclosure.

Before the present disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, a first embodiment of a microwave heating sheet of the present disclosure includes a substrate 2 and a heating layer 3. The heating layer 3 is disposed on a first surface 21 of the substrate 2, and includes a polar solvent having a boiling point of not less than 100° C., and a polyelectrolyte that is dissolved in the polar solvent.

In certain embodiments, the polyelectrolyte is present in an amount of not more than saturation solubility of the polyelectrolyte in the polar solvent. In certain embodiments, the polyelectrolyte may be a water-soluble polymer. Exemplary water-soluble polymers suitable for serving as the polyelectrolyte of this disclosure may include, but are not limited to, polyvinylpyrrolidone (PVP), chitosan, sodium polyphosphate, carboxymethyl cellulose, sodium caseinate, sodium polycrylate, and combinations thereof.

Examples of the polar solvent suitable for this disclosure may include, but are not limited to, glycerol, mannitol and a combination thereof.

In certain embodiments, the substrate 2 may be made from a porous material. Exemplary porous materials suitable for the substrate 2 of this disclosure may include, but are not limited to, cellulose paper and non-woven fabric.

In certain embodiments, the heating layer 3 is prepared by a process that includes the steps of: mixing water, the polyelectrolyte and the polar solvent to obtain a mixture having a viscosity ranging from 50 cps to 700 cps; coating the mixture on the first surface 21 of the substrate 2 to form a coating layer; and drying the coating layer to remove the water from the coating layer.

It should be noted that, the main function of the polyelectrolyte is to provide ions, and the polar solvent is used to dissolve and ionize the polyelectrolyte so as to form polycations and polyanions on the polymer chain of the polyelectrolyte. Application of microwave energy will cause the polycations and polyanions to undergo ionic polarization and collision thereamong, thereby generating thermal energy. If an amount of the polyelectrolyte is insufficient, the microwave heating effect will be poor. On the contrary, if an amount of the polyelectrolyte is in excess, not only the manufacturing cost will be increased, but also the possibility of burning the substrate 2 due to the excessively powerful microwave heating effect will become higher. Furthermore, if an amount of the polar solvent is insufficient, the polyelectrolyte cannot be completely dissolved therein. In contrast, if an amount of the polar solvent is in excess, the step of coating the mixture containing water, polyelectrolyte and the polar solvent on the first surface 21 of the substrate 2 in the abovementioned process for preparing the heating layer 3 will be easily affected by the excessive fluidity of the mixture. Therefore, in certain embodiments, the polyelectrolyte is present in an amount ranging from 21 wt % to 56 wt % based on 100 wt % of the heating layer 3.

It should be further pointed out that, the amounts of the polyelectrolyte and the polar solvent in the mixture depend on the intended viscosity of the mixture in the coating step, and on the other hand, depends on the desired heating effect (i.e., heating rate) exhibited by the heating layer 3 after application of microwave energy. In certain embodiments, the mixture is intended to have a viscosity ranging from 50 cps to 700 cps, and the heating layer 3, when heated in a microwave oven operating at a frequency of 2.45 GHz, is desired to have a temperature of higher than 85° C. in 30 seconds of heating.

Furthermore, when the heating layer 3 is formed by doctor blade coating, the viscosity of the mixture is limited to the range between 50 cps and 700 cps.

Figure 2:
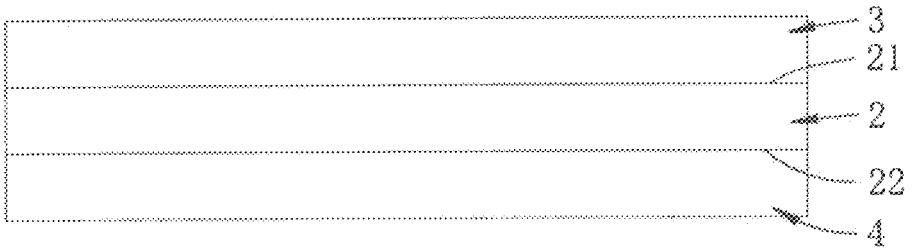
FIG. 2 is a schematic front view illustrating a second embodiment of the microwave heating sheet according to the present disclosure.

Referring to FIG. 2, a second embodiment of the microwave heating sheet of the present disclosure is similar to that of the first embodiment, except that the second embodiment further includes a food contacting layer 4 that is attached to a second surface 22 of the substrate 2 oppositely of the first surface 21 of the substrate 2. Examples of a material suitable for making the food contacting layer 4 of this disclosure may include, but are not limited to, polyethylene terephthalate (PET), polypropylene (PP), polythene (PE) and ethylene vinyl alcohol (EVOH).

The present disclosure will be further described by way of the following examples. However, it should be understood that the following examples are intended solely for the purpose of illustration and should not be construed as limiting the present disclosure in practice.

EXAMPLES

General Experimental Materials

The materials for preparing the microwave heating sheet of Examples 1 to 4, and the manufacturers and model numbers thereof, are summarized in Table 1.

TABLE 1

| Material | | Manufacturer | Model number |
|---|---|---|---|
| Polyelectrolytes | Polyvinylpyrrolidone (PVP) | Sigma-Aldrich | K30 |
| | Chitosan (of low molecular weight and water soluble) | Cabco Co., Ltd., Taiwan | Food-grade |
| | Sodium polyphosphate | Sanshun Material Equipment Co., Ltd., Taiwan | Food-grade |
| Glycerol (anhydrous) | | J. T. Baker | 2136-01 |
| Wet strength paper (for substrate 2) | | Lechung Paper Co., Ltd., Taiwan | N/A |
| Polyethylene terephthalate (PET) (heat resistance <220° C., for food contacting layer 4) | | Feng-sen Paper Co., Ltd., Taiwan | CPET |

Example 1 (E1)

First, 5 g of PVP was added to 5 ml of water, and heating was conducted under stirring until the PVP was completely dissolved. Next, a trace amount of sodium hydroxide (NaOH) was added to the thus obtained solution so that the pH thereof was adjusted to a neutral state. Then, 2 g of glycerol was added to 5 g of the solution with the neutral pH so as to form a mixture of E1 having a viscosity of 50 cps. Thereafter, an appropriate amount of the mixture of E1 was applied to first surfaces 21 of two wet strength papers by doctor blade coating utilizing different doctor blade spacing so as to form two coating layers with different thickness, respectively. Finally, the two wet strength papers with the coating layers different in thickness were dried in an oven having a temperature of 100° C. for 60 seconds and then each cut into a size of 3 cm×3 cm, thereby obtaining two microwave heating sheets of E1-1 and E1-2. The heating layers 3 of the microwave heating sheets of E1-1 and E1-2 have a weight of 0.1 g and 0.2 g, respectively. Based on calculation, the heating layers 3 formed from the mixture of E1 contain 55.56 wt % of PVP and 44.44 wt % of glycerol.

Example 2 (E2)

The procedures and conditions for preparing the microwave heating sheet of E2 were substantially similar to those of E1 except that the polyelectrolyte of E2 was chitosan, and the amount and addition order of the polyelectrolyte, the polar solvent and water for forming the mixture of E2 were different from those of E1.

Specifically, 4 g of water-soluble chitosan and 12 g of water were sequentially added to 15 g of glycerol, followed by stirring until complete dissolution so as to obtain a mixture of E2 having a viscosity of 700 cps. After that, four wet strength papers were subjected to doctor blade coating, drying and cutting steps, which were sequentially performed as mentioned in E1, thereby obtaining four microwave heating sheets of E2-1, E2-2, E2-3 and E2-4. The heating layers 3 of the microwave heating sheets of E2-1, E2-2, E2-3 and E1-4 have a weight of 0.1 g, 0.5 g, 0.035 g and 0.02 g, respectively. Based on calculation, the heating layers 3 formed from the mixture of E2 contain 21.05 wt % of chitosan and 78.95 wt % of glycerol.

Example 3 (E3)

The procedures and conditions for preparing the microwave heating sheet of E3 were substantially similar to those of E1 except that the polyelectrolyte of E3 was sodium polyphosphate, and the amount and addition order of water, the polyelectrolyte and the polar solvent for forming the mixture of E3 were different from those of E1.

Specifically, 6 g of sodium polyphosphate and 6 g of glycerol were sequentially added to 6 g of water, followed by stirring until complete dissolution so as to obtain a mixture of E3 having a viscosity of 90 cps. After that, three wet strength papers were subjected to doctor blade coating, drying and cutting steps, which were sequentially performed as mentioned in E1, thereby obtaining three microwave heating sheets of E3-1, E3-2 and E3-3. The heating layers 3 of the microwave heating sheets of E3-1, E3-2, and E3-3 have a weight of 0.025 g, 0.08 g and 0.2 g, respectively. Based on calculation, the heating layers 3 formed from the mixture of E3 contain 50 wt % of sodium polyphosphate and 50 wt % of glycerol.

Example 4

The procedures and conditions for preparing the microwave heating sheet of E4 were substantially similar to those of E2 except that after performing the doctor blade coating and drying steps on first surfaces 21 of three wet strength papers to obtain three heating layers 3, three food-grade heat resistant papers were attached to second surfaces 22 thereof. After that, the three wet strength papers with the food-grade heat resistant papers attached thereto were each cut into a similar size, thereby obtaining three microwave heating sheets of E4-1, E4-2 and E4-3. The heating layers 3 of the microwave heating sheets of E4-1, E4-2, and E4-3 have a weight of 0.0333 g, 0.0427 g and 0.0469 g, respectively.

After obtaining the microwave heating sheets of E1 to E4, a fiber optic thermometer was placed on each of the microwave heating sheets. Thereafter, each of the microwave heating sheets of E1 to E4 was heated for 30 seconds in a microwave oven operating at a frequency of 2.45 GHz to measure a change of temperature thereof, and the thus obtained results are plotted as graphs illustrating a change of temperature versus time of microwave heating in FIGS. 3 to 6.

Figure 3:
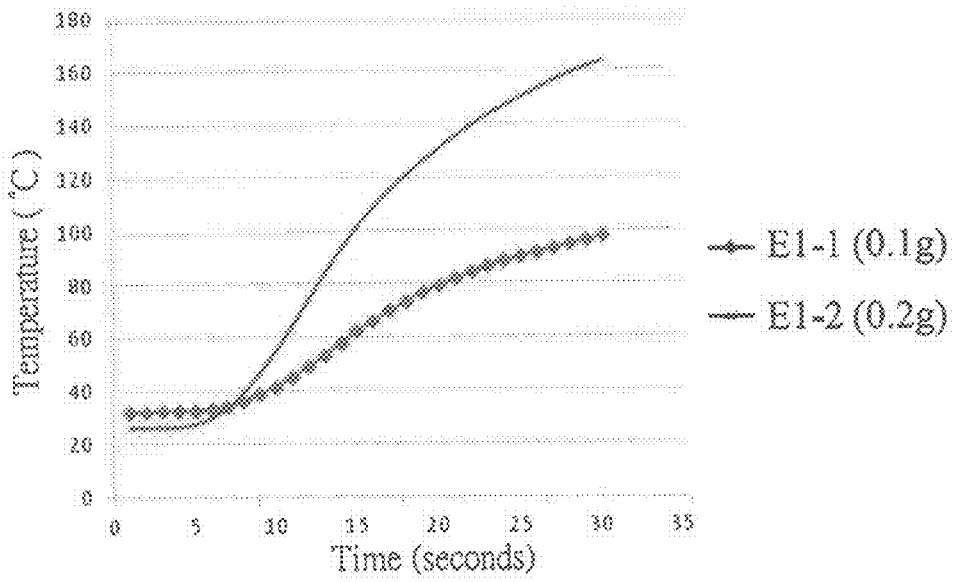
FIG. 3 is a graph illustrating changes in temperature of the microwave heating sheets of Example 1 (E1) determined at different times.

FIG. 3 shows that the heating layers 3 of the microwave heating sheets of E1-1 and E1-2 can be heated up to a temperature of 100° C. and 165° C., respectively, in 30 seconds.

Figure 4:
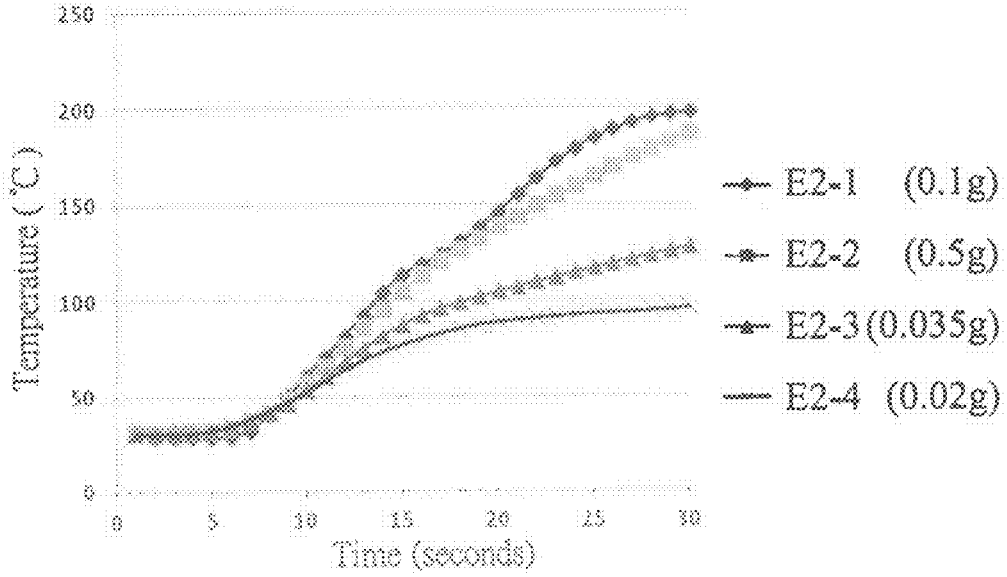
FIG. 4 is a graph illustrating changes in temperature of the microwave heating sheets of Example 2 (E2) determined at different times.

FIG. 4 shows that the heating layers 3 of the microwave heating sheets of E2-1, E2-2, E2-3 and E2-4 can be heated up to a temperature of 200° C., 188° C., 125° C. and 95° C., respectively, in 30 seconds.

Figure 5:
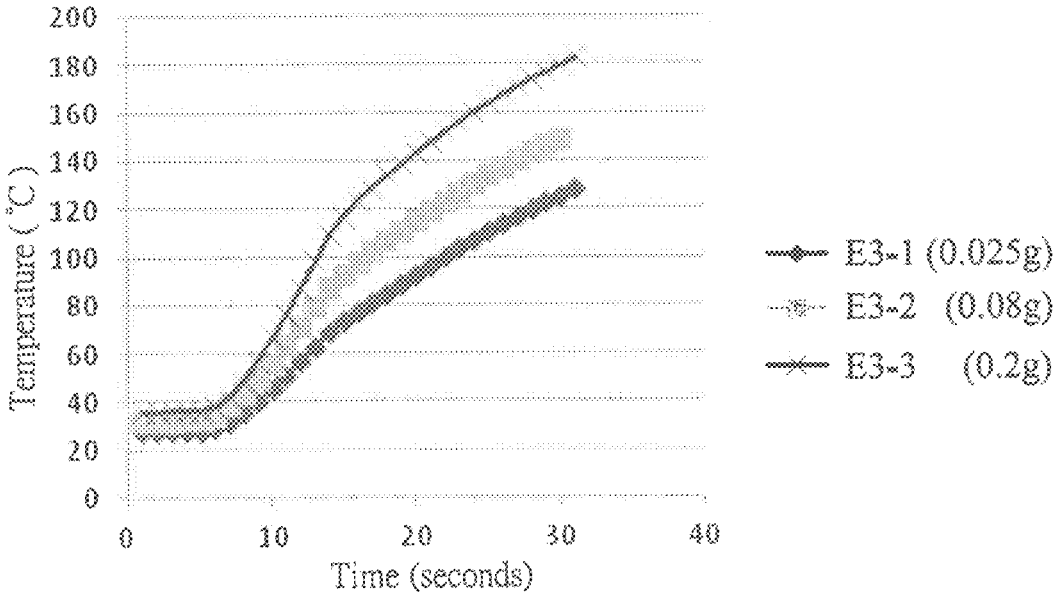
FIG. 5 is a graph illustrating changes in temperature of the microwave heating sheets of Example 3 (E3) determined at different times.

FIG. 5 shows that the heating layers 3 of the microwave heating sheets of E3-1, E3-2 and E3-3 can be heated up to a temperature of 130° C., 150° C. and 180° C., respectively, in 30 seconds.

Figure 6:
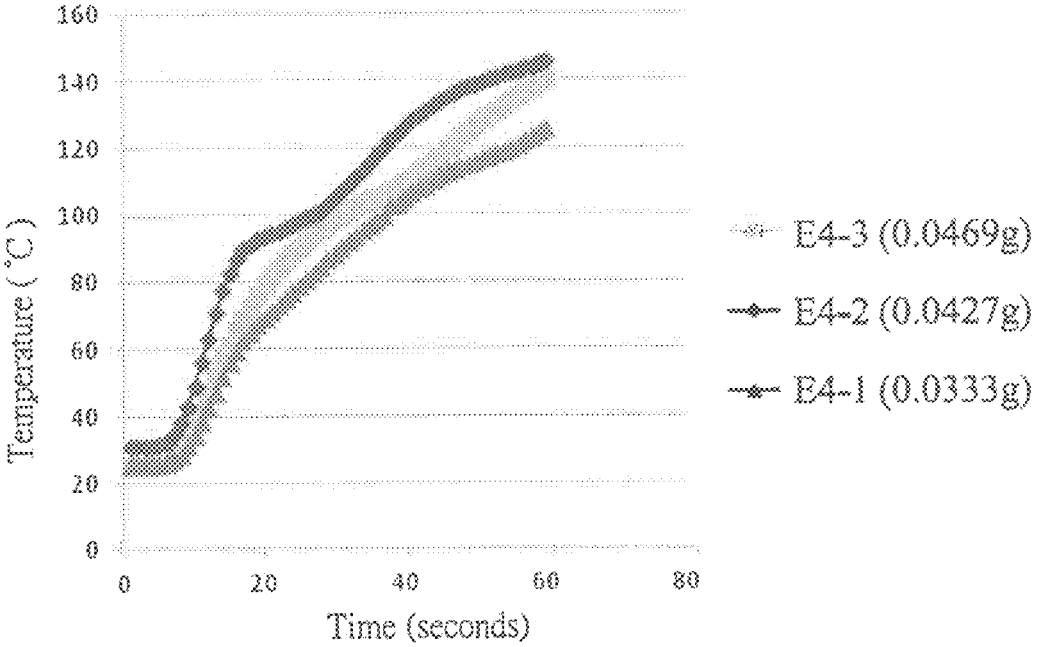
FIG. 6 is a graph illustrating changes in temperature of the microwave heating sheets of Example 4 (E4) determined at different times.

FIG. 6 shows that the heating layers 3 of the microwave heating sheets of E4-1, E4-2 and E4-3 can be heated up to a temperature of 88° C., 115° C. and 98° C., respectively, in 30 seconds.

The results show that after heating for 30 seconds in the microwave oven, the temperature of the heating layers 3 of the microwave heating sheets of E1 to E4 can be raised to higher than 85° C.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A microwave heating sheet, comprising:

a substrate; and a heating layer disposed on a first surface of said substrate and including a polar solvent that has a boiling point of not less than 100° C., and a polyelectrolyte that is dissolved in said polar solvent and is present in an amount ranging from 21 wt % to 56 wt % based on 100 wt % of the heating layer;

wherein said polyelectrolyte is chitosan.

2. The microwave heating sheet as claimed in claim 1, wherein said polar solvent is selected from the group consisting of glycerol, mannitol, and a combination thereof.

3. The microwave heating sheet as claimed in claim 2, wherein said heating layer is prepared by a process comprising the steps of:

mixing water, said polyelectrolyte and said polar solvent to obtain a mixture having a viscosity ranging from 50 to 700 cps;

coating said mixture on said first surface of said substrate to form a coating layer; and drying said coating layer to remove said water from said coating layer.

4. The microwave heating sheet as claimed in claim 1, wherein said substrate is made of a porous material.

5. The microwave heating sheet as claimed in claim 1, further comprising a food contacting layer that is adhered to a second surface of said substrate oppositely of said first surface of said substrate.

* * * * *